United States Patent [19]

Arai et al.

[11] Patent Number: 4,543,472

[45] Date of Patent: Sep. 24, 1985

[54] PLANE LIGHT SOURCE UNIT AND RADIANT HEATING FURNACE INCLUDING SAME

[75] Inventors: Tetsuji Arai; Tatsushi Igarashi, both of Hyogo, Japan

[73] Assignee: Ushio Denki Kabushiki Kaisha, Tokyo, Japan

[21] Appl. No.: 438,790

[22] Filed: Nov. 3, 1982

[51] Int. Cl.[4] ..... H05B 1/00; F27D 11/00

[52] U.S. Cl. ..... 219/411; 219/405; 219/354

[58] Field of Search ..... 219/411, 405, 354, 343, 219/347, 395; 432/147, 148, 194; 313/579

[56] References Cited

U.S. PATENT DOCUMENTS

| | | | |
|---|---|---|---|
| 2,677,748 | 5/1954 | Naylor | 219/395 |
| 2,678,958 | 5/1954 | Hintenberger | 219/395 |
| 2,981,819 | 4/1961 | Gregory | 219/405 |
| 3,239,651 | 3/1966 | Silberman | 219/411 |
| 3,240,915 | 3/1966 | Carter | 219/405 |
| 3,295,007 | 12/1966 | Young | 313/273 |
| 3,371,187 | 2/1968 | Volker | 219/405 |
| 3,416,024 | 12/1968 | Young | 313/273 |
| 3,831,053 | 8/1974 | Holcomb | 313/579 |
| 3,836,751 | 9/1974 | Anderson | 219/411 |
| 3,983,441 | 9/1976 | Northrup | 313/579 |
| 4,052,637 | 10/1977 | Op de Beeck | 313/273 |
| 4,101,759 | 7/1978 | Anthony | 219/411 |
| 4,272,698 | 1/1981 | Oyama | 313/273 |
| 4,414,484 | 11/1983 | Notelteirs | 313/273 |

FOREIGN PATENT DOCUMENTS

| | | | |
|---|---|---|---|
| 599873 | 11/1959 | Italy | 219/411 |

*Primary Examiner*—Roy N. Envall, Jr.
*Assistant Examiner*—Teresa J. Walberg
*Attorney, Agent, or Firm*—Ziems, Walter & Shannon

[57] ABSTRACT

Disclosed herein is a plane light source unit comprising a plurality of lamps disposed closely with each other in proximity to a mirror with the longitudinal axes of the lamps extending parallelly in a plane. Each of the lamps comprises an elongated sealed tubular body and a filament formed of alternating non-luminous portions and luminous portions and provided within the tubular body along the longitudinal axis of the tubular body. A radiant heating furnace comprising the above plane light source unit and a cooling system therefor is also disclosed. The plane light source unit and a radiant heating furnace incorporating the same light source unit can irradiate light onto a region of a large area with a uniform irradiation energy density. They are suitable for heat treatment of semiconductor wafers.

3 Claims, 7 Drawing Figures

PLANE LIGHT SOURCE UNIT AND RADIANT HEATING FURNACE INCLUDING SAME

BACKGROUND OF THE INVENTION

1. Field of the Invention

This invention relates to a plane light source unit and a radiant heating furnace including same. More particularly, this invention relates to a plane light source unit comprising a plurality of lamps disposed closely with each other in proximity to a mirror with the longitudinal axes of the lamps extending parallelly in a plane and a radiant heating furnace including the above plane light source unit and a cooling system therefor.

2. Description of the Prior Art

Among a variety of apparatus adapted to carry out heat treatments therein, radiant heating furnaces in which light radiated from a lamp or lamps irradiates objects or materials to be treated for heat treatment have the following merits:

(1) Owing to an extremely small heat capacity of a lamp per se, it is possible to raise or lower the heating temperature promptly;

(2) The heating temperature can be easily controlled by controlling the electric power to be fed to the lamp;

(3) Since they feature indirect heating by virtue of light radiated from their lamps which do not come into contact with the objects, there is little danger of contaminating objects under heat treatment;

(4) They enjoy less energy consumption because full-radiation-state operations of the lamps are feasible a short time after turning the lamps on and the energy efficiencies of the lamps are high; and (5) They are relatively small in size and inexpensive compared with conventional resistive furnaces and high-frequency heating furnaces.

Such radiant heating furnaces have been used for the heat treatment and drying of steel materials and the like and the molding of plastics as well as in thermal characteristics testing apparatus and the like. Use of radiant heating furnaces have, particularly recently, been contemplated to replace the conventionally-employed resistive furnaces and high-frequency heating furnaces for heat treating of semiconductor wafers, such as, for example, drive-in diffusion processes, chemical vapor deposition processes, annealing processes of ion-implanted dopants and thermal processes for nitrifying or oxidizing the surfaces of silicon wafers. As reasons for the above move, using a radiant heating furnace, it is possible to activate the ion-implanted atoms with minimal redistribution because heat treating of the wafers at a higher temperature can be achieved in a shorter period of time, in addition to the advantages, such as little contamination, less power consumption, etc. Minimal redistribution of dopant implanted results in steeper and shallower junctions meaning potentially smaller and faster devices. Another reason is that with increasing semiconductor wafer size uniform heat treating by conventional resistive furnaces is more difficult.

As aforementioned, radiant heating furnaces have various merits and advantages and have already found wide-spread commercial utility in the industry. However, conventional radiant heating furnaces are accompanied by such drawbacks that they are unable to irradiate light onto objects of large areas and to heat them uniformly to high temperatures in short periods of time. In other words, each lamp is equipped with a sealed body made of silica glass or the like and forms a point or line light source. Thus, it is very difficult to form a plane light source having a two-dimensional extent when used solely. Accordingly, it cannot uniformly heat any region of a large area to a high temperature in a short period of time.

SUMMARY OF THE INVENTION

The present invention has been completed in view of the above-mentioned state of the art. Accordingly, an object of this invention is to provide a plane light source unit which can irradiate light with a uniform irradiation energy density onto a region of a large area.

Another object of this invention is to provide a radiant heating furnace capable of heating an object or material of a large area with a uniform irradiation energy density.

In one fundamental aspect of this invention, there is thus provided a plane light source unit comprising a plurality of lamps, each of which comprises an elongated sealed tubular body and a filament formed of alternating non-luminous portions and luminous portions and provided within the tubular body along the longitudinal axis of the tubular body, disposed closely with each other in proximity to a mirror, with the longitudinal axes of the lamps extending parallelly in a plane.

In another aspect of this invention, there is also provided a radiant heating furnace comprising such a plane light source unit or units as mentioned just above and a cooling system adapted to cool each plane light source unit.

The plane light source unit according to this invention is thus capable of irradiating light onto a region of a large area with a uniform irradiation energy density. On the other hand, the radiant heating furnace according to the present invention can heat an object of a large area with a uniform irradiation energy density to a high temperature and in a short period of time and is thus suitable particularly for heat treatments of semiconductor wafers. Moreover, the service life of each lamp will not be shortened.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENT

Figure 1:
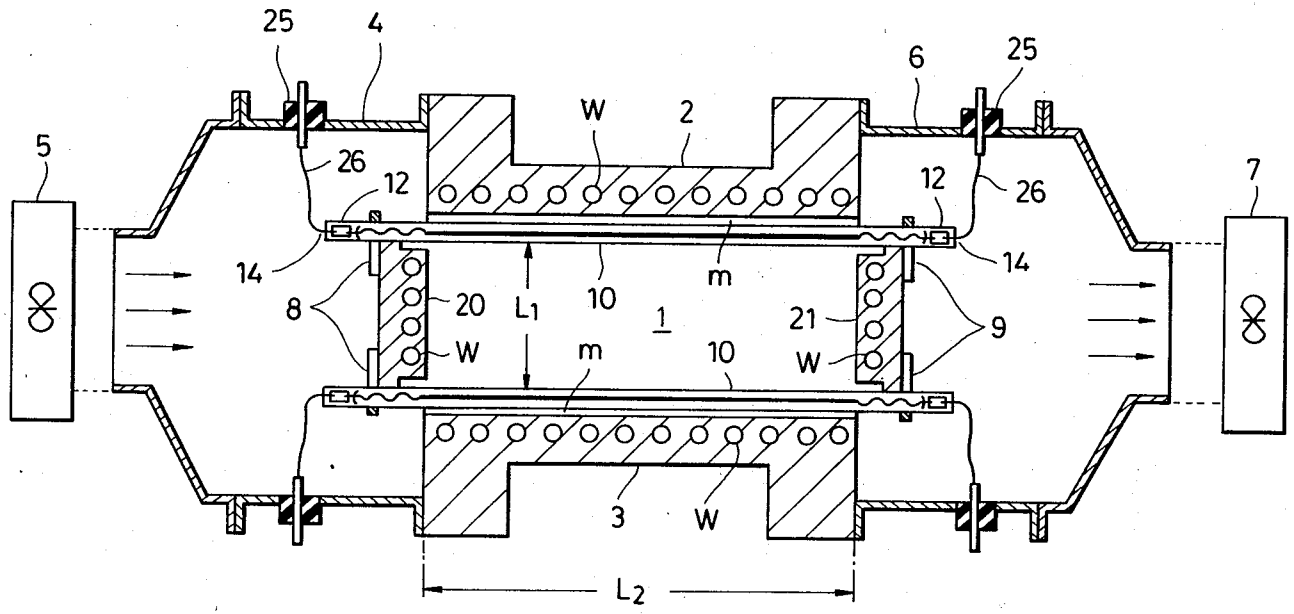
FIG. 1 is a schematic, cross-sectional view showing a radiant heating furnace according to one embodiment of this invention, which is provided with plane light source units to which the present invention is also directed.
Figure 2:
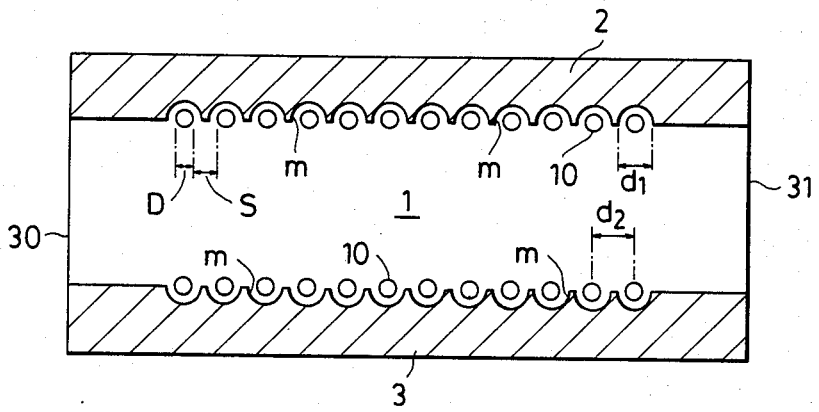
FIG. 2 is a schematic, transverse, cross-sectional view of certain lamps and mirrors of FIG. 1.

FIG. 1 illustrates, as mentioned above, the structure of a radiant heating furnace according to one embodiment of this invention. In this embodiment, as also shown in FIG. 2, main mirrors 2 and 3 are arranged in such a way that they cover respectively the upper and lower boundaries of an irradiation space 1 in which an object to be treated is placed. The reflecting surface of each of these main mirrors 2 and 3 defines a plurality of semi-circular grooves m which are parallel and close to one another. These grooves m extend over the entire longitudinal length of each of the main mirrors 2 and 3 (namely, in the horizontal direction in FIG. 1 but in the direction perpendicular to the drawing sheet in FIG. 2). At one longitudinal end of the main mirrors 2 and 3, there is coupled a first air-path member 4 which is in turn connected to a blower 5. On the other hand, the main mirrors 2 and 3 terminate at the other longitudinal end thereof in a second air-path member 6 which is connected to an exhauster 7. Near the outlet of the first air-path member 4 and adjacent to the inlet of the second air-path member 6, there are provided lamp supports 8 and 9, respectively. The former lamp support 8 corresponds to the one end of the main mirrors 2 and 3 and the latter lamp support 9 corresponds to the other end of the same main mirrors 2 and 3. These lamp supports 8 and 9 support their corresponding end portions of elongated, tubular lamps 10 which extend along their corresponding gutter-like grooves m in the main mirrors 2 and 3. Therefore, in proximity to the upper main mirror 2, a plurality of lamps 10 are disposed closely with each other, with the longitudinal axes thereof extending parallelly in a plane along the upper main mirror 2, thereby forming an upper plane light source unit which faces the irradiation space 1, and in proximity to the lower main mirror 3, a lower plane light source unit which also faces the irradiation space 1 has the same arrangement of lamps 10 as in the upper plane light source unit. It is desired to use halogen lamps as the lamps 10.

Figure 3:
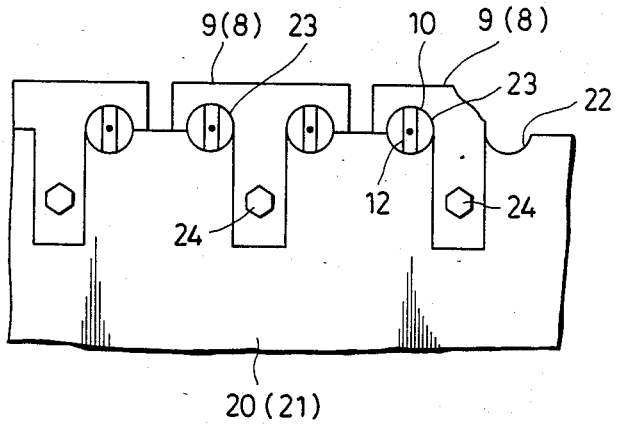
FIG. 3 is a fragmentary side elevation for illustrating the manner of supporting the lamps.

As shown in FIG. 3, the lamp supports 8 and 9 are fixed by means of screws 24, onto side mirrors 20 and 21, respectively, which are disposed to cover up both sides of the irradiation space 1 and are provided with mirrored surfaces on their inner walls. Along the upper and lower edges of each of the side mirrors 20 and 21, the lamp supports 8 and 9 hold at their serrated holding parts 23 lamps 10 at their tube-shaped parts adjacent to their corresponding sealed portions 12 and 12, in association with corresponding lamp-receiving serrations 22 formed in the side mirrors 20 and 21 at locations in correspondence with the grooves m. Therefore, as depicted in FIG. 1, the sealed portions 12 and 12 of each lamp 10 are exposed out of the irradiation space 1. In other words, they are positioned in the first air-path member 4 and second air-path member 6. Outer leads 14 and 14, which extend outwardly from the sealed portions 12 and 12 thus exposed, are connected to current feed lines 26 and 26 extending through the walls of the first and second air-path members 4 and 6 with insulators 25 and 25 such as Teflon or the like applied therebetween.

Furthermore, the main mirrors 2 and 3 and side mirrors 20 and 21 are each provided with a water-cooling system. More specifically, each of the main mirrors 2 and 3 and side mirrors 21 and 22 defines water channels W which extend through its body. These water channels W are communicated with a cooling water supply system (not shown).

Figure 4:
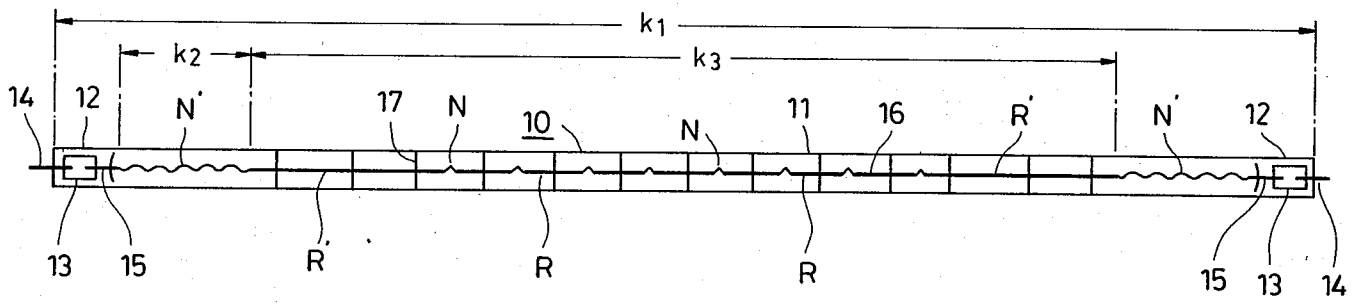
FIG. 4 is a simplified, schematic, cross-sectional view of a lamp employed in this invention.

In the above embodiment, each of the lamps 10 is, as shown in FIG. 4, made of a sealed tubular body 11 made of translucent quartz, conductive members 13 and 13 made of metal foils and sealed in their respective sealed portions 12 and 12 formed respectively at both ends of the sealed body 11, outer leads 14 and 14 extending from the conductive members 13 and 13 to points outside the sealed body 11, internal leads 15 and 15 extending from the conductive members 13 and 13 to the interior of the sealed body 11, filament 16 connected at both ends thereof to the inner leads 15 and 15 and disposed along the longitudinal axis of the sealed tubular body 11, and filament supporters 17. The filament 16 is provided alternatingly with non-luminous portions N,N and luminous portions R,R,R',R' and is provided at both ends thereof with non-luminous end portions N' and N'.

Next, exemplary specific figures will be given. Each of the grooves m of the main mirror 2 and 3 has a semicircular shape and its diameter $d_1$ is 20 mm. The distance $d_2$ between the centers of each two adjacent semicircular grooves m is 21 mm. Each lamp 10 has a total length $k_1$ of 335 mm. The sealed body 11 has an external diameter D of 10 mm at its tubular portion. The non-luminous end portions N' and N' of the filament 16 have individually a length $k_2$ of 37 mm. The length $k_3$ of the filament 16 without the non-luminous end portions N' and N' is 230 mm. The lamps 10 are each rated as 230 V - 3200 W. The upper lamps 10 are separated through the irradiation space 1 from their corresponding lower lamps 10 by a distance $L_1$ of 80 mm. The distance $L_2$ between the side mirrors 20 and 21 is 230 mm. The lamps 10 are arranged in such a way that their longitudinal axes lie at positions displaced by from 1 to 2 mm toward the corresponding main mirror 2 or 3 from the centers of the corresponding semicircular grooves m. The blower 5 and exhauster 7, which are coupled respectively to the first air-path member 4 and the second air-path member 6, have a maximum air current of 8 $m^3$/min. Thus, upon turning on the lamps 10, light radiated from the lamps 10 is irradiated into the irradiation space 1, together with light reflected at the main mirrors 2 and 3 and side mirrors 20 and 21. Then, an object to be treated is placed within the irradiation space 1 by means of a conveyance mechanism such as belt conveyor or the like so that the object is caused to pass through openings 30 and 31 (see, FIG. 2) in a direction perpendicular to the drawing sheet in FIG. 1, thereby effecting the heat treatment of the object. In order to avoid undesirable influences to the heating characteristics of the object due to the cooling wind, a translucent vessel or case made of transparent quartz, for example, may be provided in the irradiation space 1 in which the object is placed or through which the object is conveyed.

In the above arrangement, the plurality of the tubular lamps 10 are disposed very closely and parallely to one another in a plane. Each of the lamps 10 forms a line light source when used individually. However, the plurality of the lamps 10 actually form a plane light source with respect to the object present in the irradiation space 1. The illuminance distribution on the plane at which the surface of the object is positioned in a direction transverse the lamps 10 can be made uniform by setting the width S between each two adjacent lamps 10 equal or otherwise suitably.

Figure 6A:
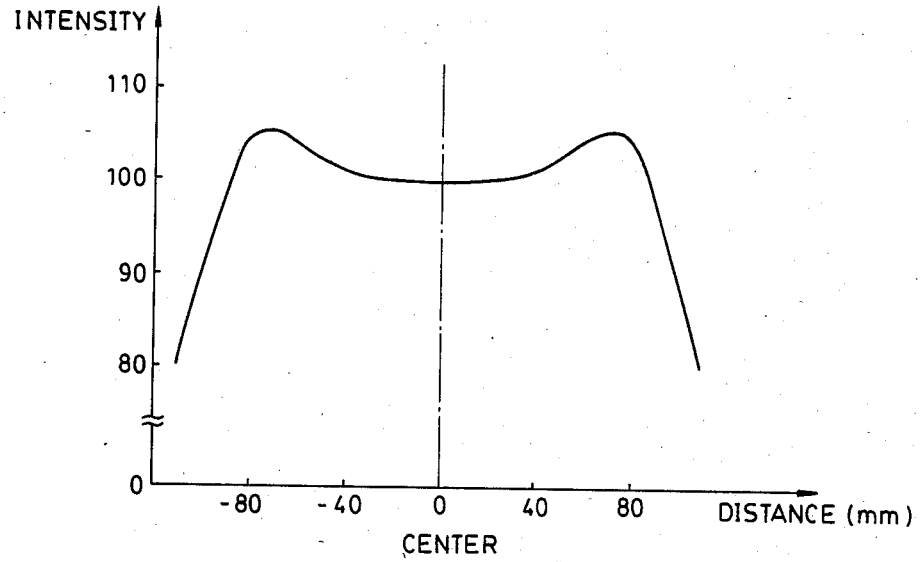
FIG. 6A and FIG. 6B are diagrams showing characteristic curves of illuminance respectively when lamps of the same type as that shown in FIG. 4 are used solely and in combination with a mirror.
Figure 6B:
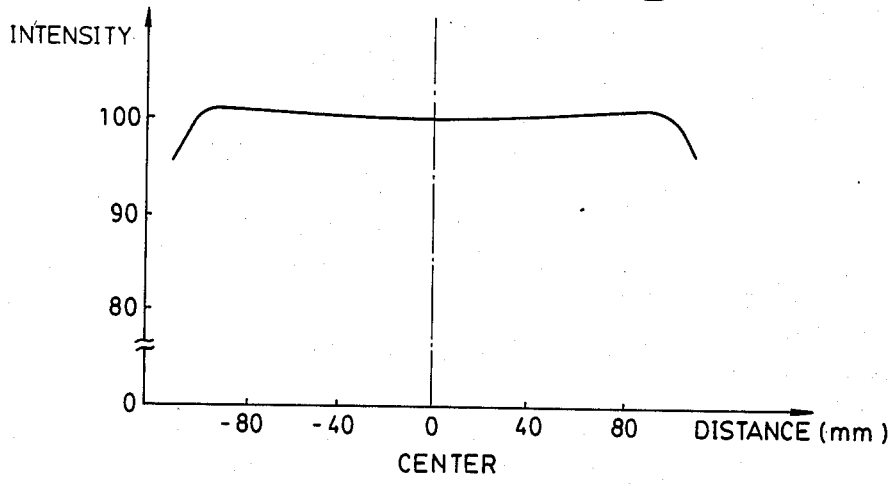

On the other hand, the filament 16 of each lamp 10 has alternatingly-arranged non-luminous portions N and luminous portions R. Therefore, the illuminance distribution on the plane in a direction along the lamps 10 may also have been rendered uniform along its length. Consequently, the above radiant heating furnace can heat an object of a large area with a highly-uniform and a high irradiation energy density. More specifically, as shown in FIG. 6A, the illuminance pattern of each lamp 10 at a level remote by 45 mm from the longitudinal axis of the lamp 10 has higher levels of illuminance at both end portions than its central portion owing to inclusion of longer luminous end portions R',R' in the filament 16. However, when the lamp 10 is combined with the mirror having above-described groove m of aforementioned configurations or dimensions, the illuminance pattern at the same level becomes, as shown in FIG. 6B, flat and uniform along its entire length. Accordingly, light is irradiated with the uniform irradiation density in the irradiation space 1 both in the direction transverse to the parallelly-disposed lamps 10 and in the longitudinal direction of the lamps 10, thereby making it possible to heat the entire surface of each object uniformly.

In the above embodiment, each lamp 10 is forcedly cooled along its entire length by the wind, which flows along the sealed body 11 of the lamp 10 from one end thereof located in the vicinity of the outlet of the first air-path member 4 owing to the provision of the blower 5, and by the wind which flows along the sealed body of the lamp 10 toward the other end thereof located in the proximity of the inlet of the second air-path member 6 owing to the provision of the exhauster 7. At the same time, the main mirrors 2 and 3 are also cooled over their entire lengths. Thus, by controlling the air current of the blower 5 and that of the exhauster 7 at the same or similar level, the sealed body 11 of each of the lamps 10 and the main mirrors 2 and 3 can be equally cooled in their lengthwise direction under good conditions, whether an object is present for its treatment in the irradiation space 1 or not. Since the sealed portions 12 and 12 of each lamp 10 are positioned outwardly beyond their corresponding side mirrors 20 and 21, they do not receive direct light from other lamps; less heat is transmitted from the central portion of the sealed body 11 of the lamp 10 to the sealed portions 12 and 12 owing to the holding of the lamp 10 at its tubular wall portions embracing the non-luminous end portions N' and N' of the filament 16 by their corresponding side mirrors 20 and 21, which are provided with the water-cooling systems and the lamp supports 8 and 9 which cooperate with their corresponding side mirrors 20 and 21; and the sealed portions 12 and 12 are effectively cooled owing to their exposure in the first and second air-path members 4 and 6. Consequently, the sealed portions 12 and 12 of the lamp 10 are protected from degradation. Therefore, the sealed body 11 and sealed portions 12 and 12 of the lamp 10 are prevented from becoming excessively hot even if lamps of a large output are used as the lamps 10 or the distance between each two adjacent lamps 10 is minimized to increase the irradiation energy density, thereby avoiding the possible disadvantage of shortening their service life.

Figure 5:
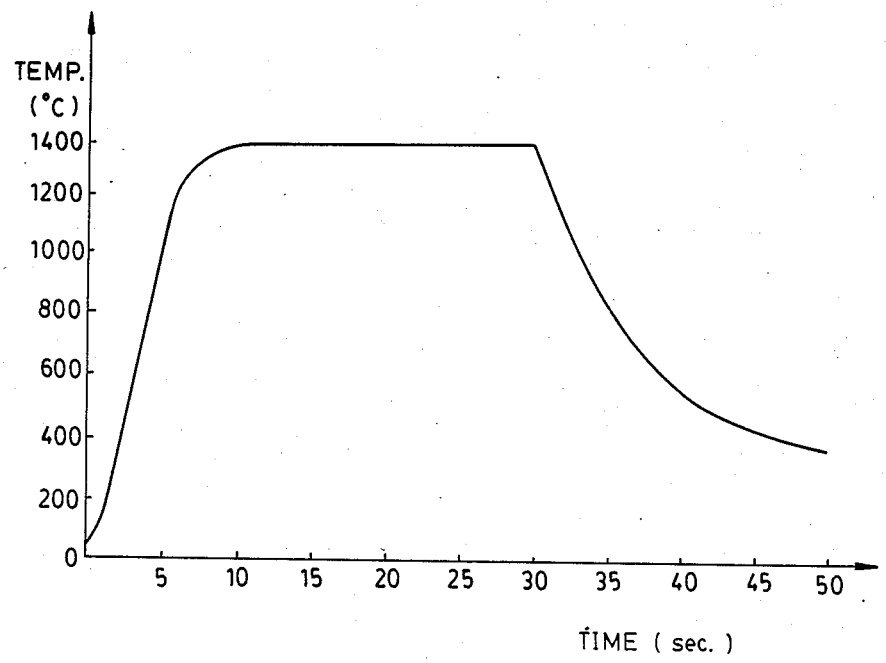
FIG. 5 is a diagram showing a characteristic curve of reached temperatures of an object as a function of time, obtained using an actual radiant heating furnace according to this invention.

Temperature-raising tests were carried out using the above radiant heating furnace. A temperature increase when each lamp 10 was supplied for 30 seconds with an electric power of 1600 W, which was one half of its rated power supply, was measured by a thermocouple bonded to a silicon wafer, the object, of 450 μm thickness and 4 inches diameter set in the translucent quartz vessel and held at the center level position in the irradiation space 1. The temperature variation is diagrammatically illustrated in FIG. 5. Namely, the temperature reached as high as 1400° C. in 10 seconds after turning on the lamps 10. When the lamps 10 were supplied with their rated power supply, i.e., an electric power of 3200 W, 1400° C. was reached in 3 seconds after turning on the lamps 10. In each of the above tests, the surface layer of the silicon wafer was fused finally in a short period of time. It is important in the semiconductor processings to obtain such a high temperature as capable of fusing silicon wafers in a short period of time. Owing to the above feature, the radiant heating furnace according to this invention can be adapted to raise the temperature of a silicon wafer or the like having a large area in a short period of time, which was unfeasible in conventional heating furnaces.

Other advantages of the present invention will hereinafter be described. Each of the lamps 10 is supported at its outer wall portions adjacent to the sealed end portions 12 and 12 of its sealed body 11 by means of the lamp supports 8 and 9, instead of relying upon the conventional support method, i.e., providing base shells with both sealed end portions and supporting the lamp via the base shells. Therefore, the sealed portions 12 and 12 are kept exposed in a bare state and heat can be effectively released or dissipated from the sealed portions 12 and 12. This protects the conductive members 13 and 13 sealed in the sealed portions 12 and 12 from oxidation due to the increase of temperature, thereby avoiding the reduction in service life of the lamps. The above advantage may be enhanced further when the sealed portions 12 and 12 are placed in cooled air-paths. The lamp supports 8 and 9, supporting the lamps 10, can be forcedly cooled also by heat conduction of the water-cooled side mirrors 20 and 21 which are in contact with the lamp supports 8 and 9. Accordingly, the lamp supports 8 and 9 are kept free from deleterious influence such as thermal deformation or the like. In the case that a halogen lamp of a large output such as mentioned above is used as the lamp 10, the temperatures of the portions at which the lamp is supported will not drop below 120° C., and then the halogen cycle will not suppressed in each halogen lamp. Thus, a halogen lamp may be successfully applied as the lamp 10. In addition, when subjecting a semiconductor wafer to heat treatment in a radiant heating furnace equipped with lamps having base shells, such dusts as fragments of their bond will be produced and will give serious deleterious influence to the characteristics of the semiconductor wafer. However, the radiant heating furnace according to this invention is free from such problem because at the sealed portions 12 and 12 of each lamp 10 no base shells and no bond are used.

Having now fully described the invention, it will be apparent to one of ordinary skill in the art that many changes and modifications can be made thereto without departing from the spirit or scope of the invention as set forth herein.

What is claimed is:

1. A radiant heating furnace comprising:

at least one plane light source unit arranged along a boundary of an irradiation space and having means for evenly distributing heat comprising a plurality of halogen lamps, each of said halogen lamps comprising an elongated sealed tubular body defining a longitudinal axis, said body including a tubular wall portion and sealed end portions, and a filament formed of alternating non-luminous portions and luminous portions in the tubular body along the longitudinal axis;

a mirror positioned in proximity to said halogen lamps;

side mirrors spaced from one another and arranged along the irradiation space generally orthogonal to said plane light source unit;

a cooling system adapted to cool the plane light source unit; and lamp supports mounted on said side mirrors, wherein said halogen lamps are disposed close to each other with the longitudinal axes thereof parallel and lying in a common plane, each of said lamps being supported at its tubular wall portion adjacent to its sealed end portions by said lamp supports, said sealed end portions being exposed and uncovered; and said cooling system includes a water cooling system comprising water channels extending through said side mirrors, said water channels being in communication with a cooling water supply system.

2. A radiant heating furnace as claimed in claim 1, wherein two plane light source units are arranged along opposite boundaries of the irradiation space so as to face each other.

3. A radiant heating furnace as claimed in claim 2, wherein the cooling system includes an air cooling system which comprises an air-path member coupled to ends of the mirrors of the two plane light source units, cooling air being flowed through the air-path member by a fan.

* * * * *